US009211996B2

(12) United States Patent
Petrucci et al.

(10) Patent No.: US 9,211,996 B2
(45) Date of Patent: Dec. 15, 2015

(54) PACKAGE OF SMOKING ARTICLES WITH A SLIDING OPENING AND A HINGED LID

(71) Applicant: JAPAN TOBACCO INC., Tokyo (JP)

(72) Inventors: Luca Petrucci, Castelfranco Emilia (IT); Michele Squarzoni, Ferrara (IT)

(73) Assignee: JAPAN TOBACCO INC., Tokyo (JP)

( * ) Notice: Subject to any disclaimer, the term of this patent is extended or adjusted under 35 U.S.C. 154(b) by 0 days.

(21) Appl. No.: 14/272,218

(22) Filed: May 7, 2014

(65) Prior Publication Data

US 2014/0238877 A1 Aug. 28, 2014

Related U.S. Application Data

(63) Continuation of application No. PCT/IB2012/056261, filed on Nov. 8, 2012.

(30) Foreign Application Priority Data

Nov. 8, 2011 (IT) ..... BO2011A0635

(51) Int. Cl.
*B65D 85/10* (2006.01)
*A24F 15/16* (2006.01)

(52) U.S. Cl.
CPC ..... *B65D 85/1009* (2013.01); *A24F 15/16* (2013.01); *B65D 85/1045* (2013.01); *B65D 85/1054* (2013.01)

(58) Field of Classification Search
CPC ..... B65D 85/1054; B65D 85/1045; B65D 85/10; B65D 85/1027; B65D 5/6688; B65D 5/0085; B65D 5/723; B65D 5/4291; A24F 15/12; A24F 15/00
USPC ..... 206/255, 273, 250, 252, 270, 249, 242, 206/261, 268; 229/129.1, 160.1, 160.2, 229/125.37, 125.08; D27/186–191
See application file for complete search history.

(56) References Cited

U.S. PATENT DOCUMENTS 439,993 A * 11/1890 Bailey ..... 229/121
664,141 A 12/1900 Fredrikson (Continued)

FOREIGN PATENT DOCUMENTS

CN 101065301 A 10/2007
CN 201472744 U 5/2010

(Continued)

OTHER PUBLICATIONS

China Office Action dated Jan. 4, 2015 for CN 2014122901302650.

(Continued)

*Primary Examiner* — Mickey Yu
*Assistant Examiner* — Gideon Weinerth
(74) *Attorney, Agent, or Firm* — Birch, Stewart, Kolasch & Birch, LLP

(57) ABSTRACT

A package of tobacco articles including an inner container which houses a group of tobacco articles, and has an open top end, and a lid hinged to close the open top end, an outer container housing the inner container to allow the inner container to slide with respect to the outer container between a closed configuration and an open configuration, and a sealing flap hinged to a top edge of a front wall of the outer container and movable between a work position, in which the sealing flap is perpendicular to the front wall of the outer container and located beneath a top wall of the lid of the inner container, and a rest position, in which the sealing flap is parallel to the front wall of the outer container.

8 Claims, 9 Drawing Sheets

(56) References Cited

U.S. PATENT DOCUMENTS

| | | | | | |
|---|---|---|---|---|---|
| 1,185,560 | A | * | 5/1916 | Walcutt | 229/129.1 |
| 2,799,441 | A | * | 7/1957 | Nerney | 229/122.34 |
| 2,919,845 | A | * | 1/1960 | Hackmyer | 229/129 |
| 2,990,994 | A | * | 7/1961 | Hackmyer | 229/129.1 |
| 3,102,675 | A | * | 9/1963 | Schrom | 206/251 |
| 3,132,790 | A | * | 5/1964 | Capuccio | 206/268 |
| 3,204,852 | A | * | 9/1965 | Capucio | 206/268 |
| 3,231,170 | A | | 1/1966 | Robinson | |
| 3,311,283 | A | * | 3/1967 | Shimada et al. | 229/125.08 |
| 3,400,874 | A | * | 9/1968 | Shimada et al. | 206/250 |
| 3,899,125 | A | * | 8/1975 | Andrews et al. | 220/495.01 |
| 3,933,299 | A | * | 1/1976 | Shimada et al. | 229/125.37 |
| 4,049,117 | A | * | 9/1977 | Grimm | 206/270 |
| 4,240,548 | A | * | 12/1980 | Stio | 206/250 |
| 4,267,926 | A | * | 5/1981 | Toimil | 206/268 |
| 4,646,960 | A | * | 3/1987 | Challand | 206/259 |
| 6,105,856 | A | * | 8/2000 | Kakiuchi | 229/148 |
| 6,334,532 | B1 | * | 1/2002 | Tambo et al. | 206/268 |
| 7,658,280 | B2 | | 2/2010 | Bardet et al. | |
| 8,281,922 | B2 | * | 10/2012 | Chatelain | 206/267 |
| 8,474,612 | B2 | * | 7/2013 | Bertuzzi et al. | 206/264 |
| 2005/0199517 | A1 | * | 9/2005 | Petrucci et al. | 206/261 |
| 2006/0070896 | A1 | | 4/2006 | Focke et al. | |
| 2007/0193896 | A1 | | 8/2007 | Tanbo et al. | |
| 2007/0251984 | A1 | | 11/2007 | Bardet et al. | |
| 2008/0223912 | A1 | | 9/2008 | Ardite et al. | |
| 2009/0205982 | A1 | * | 8/2009 | Hein et al. | 206/251 |
| 2011/0062175 | A1 | | 3/2011 | Nakamura et al. | |
| 2013/0248392 | A1 | * | 9/2013 | Roila et al. | 206/255 |
| 2015/0014404 | A1 | * | 1/2015 | Iwata et al. | 229/160.1 |

FOREIGN PATENT DOCUMENTS

| | | | |
|---|---|---|---|
| CN | 201756274 | U | 3/2011 |
| EP | 0 183 397 | A2 | 6/1986 |
| EP | 1 847 478 | A1 | 10/2007 |
| JP | 49-8341 | A | 1/1974 |
| JP | 2008504181 | A | 2/2008 |
| JP | 2009-292516 | A | 12/2009 |
| KR | 1020110002087 | A | 1/2011 |
| RU | 2 424 962 | C2 | 7/2010 |
| WO | WO 2008/054305 | A1 | 5/2008 |

OTHER PUBLICATIONS

German Search Report dated Jan. 19, 2015 for DE 14193405.9.

China Office Action dated Jan. 4, 2015 for CN 201280054881.4.

European Search Report dated Jan. 19, 2015 for EP 14193405.9.

Office Action for Ukraine Application No. a2014 06306 dated Mar. 27, 2015, and translation.

Canadian Office Action in Application No. 2,854,938 dated Jun. 9, 2015.

Japanese Office Action in Application No. 2014-540616 dated Jun. 4, 2015, and translation.

Russian Official Decision on Grant issued on Jul. 2, 2015 in corresponding Russian Patent Application No. 2014123328 with English. translation.

Notification of Reason for Refusal dated Oct. 5, 2015 in co-pending application 10-2014-7015001.

* cited by examiner

PACKAGE OF SMOKING ARTICLES WITH A SLIDING OPENING AND A HINGED LID

CROSS-REFERENCE TO RELATED APPLICATION

This application is a continuation of International Application PCT/IB2012/056261 which was filed on Nov. 8, 2012, and claims priority from Italia Patent Application BO2011A000635 which was filed on Nov. 8, 2011, the contents of which are herein wholly incorporated by reference.

FIELD

The present invention relates to a hinged-lid, slide-open package of tobacco articles.

In the following description, reference is made, for the sake of simplicity and purely by way of example, to a hinged-lid, slide-open packet of cigarettes.

BACKGROUND

Rigid, hinged-lid packets of cigarettes are currently the most widely marketed, by being easy to produce and easy and practical to use, and by effectively protecting the cigarettes inside.

In packets of cigarettes, loose tobacco powder (or flecks, i.e. minute fragments of tobacco which spill from the tips of the cigarettes due to movement of the packet) accumulate increasingly as the cigarettes inside the packet are consumed.

In addition to the above rigid, hinged-lid packets of cigarettes, rigid slide-open packets have been proposed comprising two partly separable containers, one inserted inside the other. In other words, a rigid, slide-open packet of cigarettes comprises an inner container, which houses a foil-wrapped group of cigarettes and is housed inside an outer container to slide, with respect to the outer container, between a closed configuration, in which the inner container is inserted inside the outer container, and an open configuration, in which the inner container is partly-extracted from the outer container.

A rigid, hinged-lid, slide-open packet of cigarettes has also been proposed in which the inner container has a hinged lid, which rotates between a closed position and an open position closing and opening an open top end of the inner container. The inner container lid has a connecting tab connected at one end to the lid, and at the other end to the outer container, to 'automatically' rotate the lid (i.e. without the user having to touch the lid) as the inner c.

However, when turned upside down (as often happens inside the user's bag or pocket), rigid, hinged-lid, slide-open packets of cigarettes tend to spill tobacco powder, which substantially escapes through the gap between the front edge of the top wall of the inner container lid and the opposite top edge of the front wall of the outer container. To prevent tobacco powder spill, it has been proposed to add a sealing flap connected (hinged) to the top edge of the front wall of the outer container and movable between a work position (assumed in the closed configuration, i.e. when the inner container is inserted fully inside the outer container) and a rest position (assumed in the open configuration, i.e. when the inner container is extracted partly from the outer container). In the work position, the sealing flap is perpendicular to the front wall of the outer container and located beneath the top wall of the inner container lid to prevent tobacco powder spill by 'sealing' the gap between the front edge of the top wall of the inner container lid and the opposite top edge of the front wall of the outer container. In the rest position, the sealing flap is parallel to the front wall of the outer container, to avoid interfering with the movement of the inner container with respect to the outer container.

In known rigid, hinged-lid, slide-open packets of cigarettes, however, it has been observed that the sealing flap does not always return from the rest to the work position A 'automatically' (i.e. with no help from the user) when the inner container is pushed from the open to the closed configuration (i.e. is pushed inside the outer container).

SUMMARY

It is an object of the present invention to provide a hinged-lid, slide-open package of tobacco articles designed to eliminate the above drawbacks, and which in particular is cheap and easy to produce.

According to the present invention, there is provided a hinged-lid, slide-open package of tobacco articles, as claimed in the accompanying Claims.

BRIEF DESCRIPTION OF THE DRAWINGS

A non-limiting embodiment of the present invention will be described by way of example with reference to the accompanying drawings.

DESCRIPTION OF EMBODIMENTS

Figure 1:
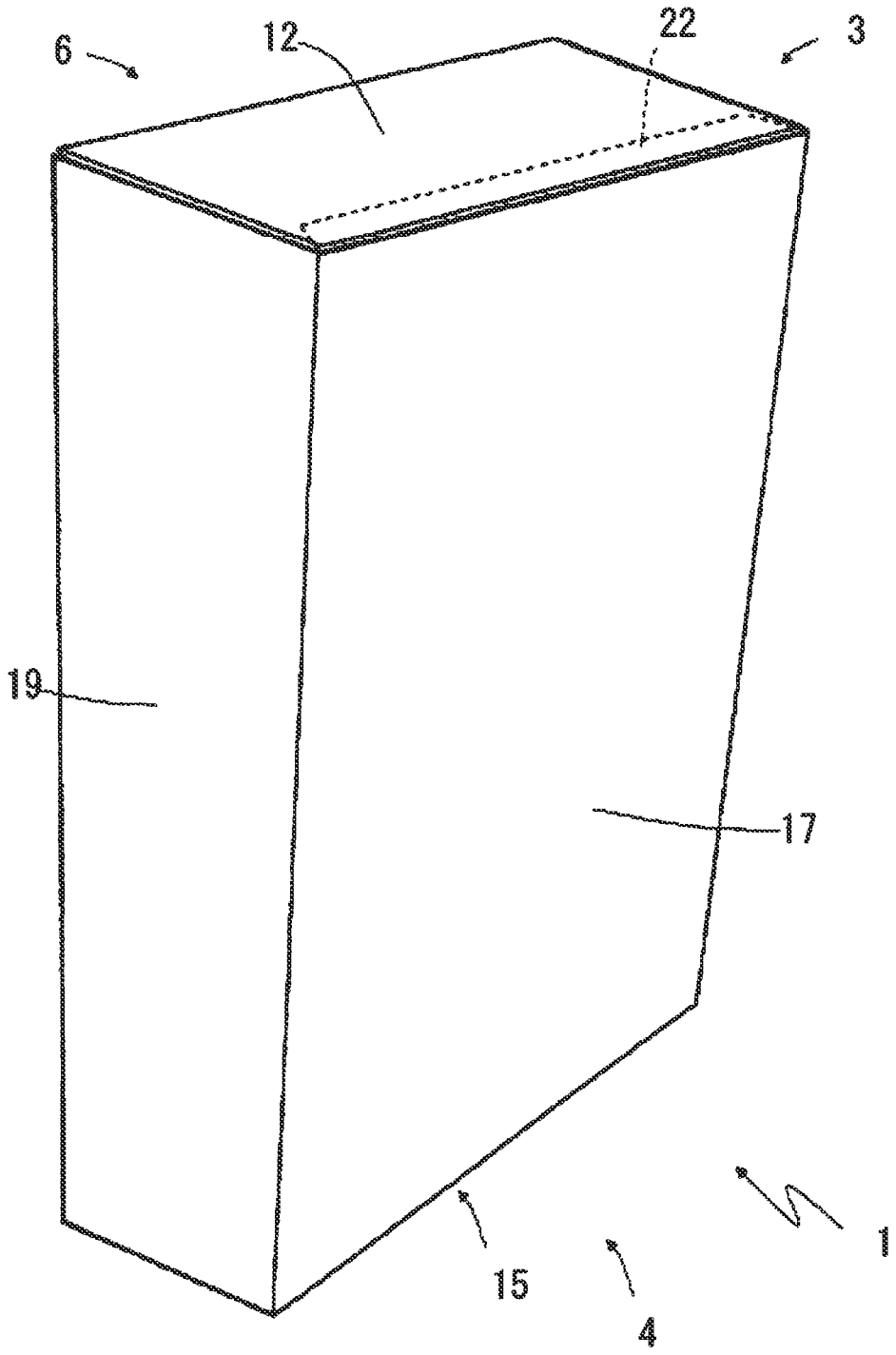
FIG. 1 shows a front view in perspective of a rigid, hinged-lid, slide-open packet of cigarettes, in accordance with the present invention and in a closed configuration.
Figure 2:
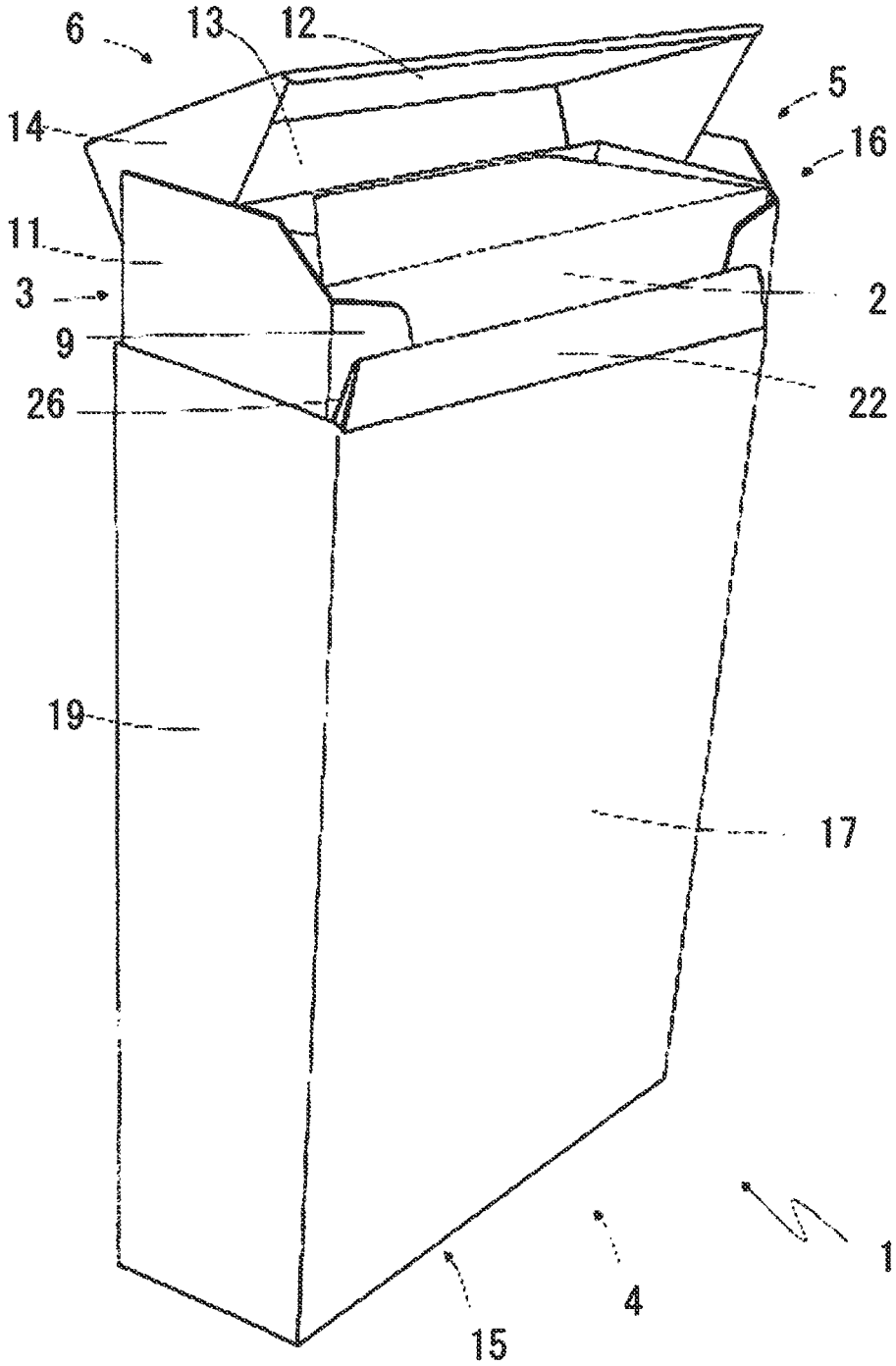
FIG. 2 shows a front view in perspective of the FIG. 1 packet of cigarettes in an open configuration.
Figure 3:
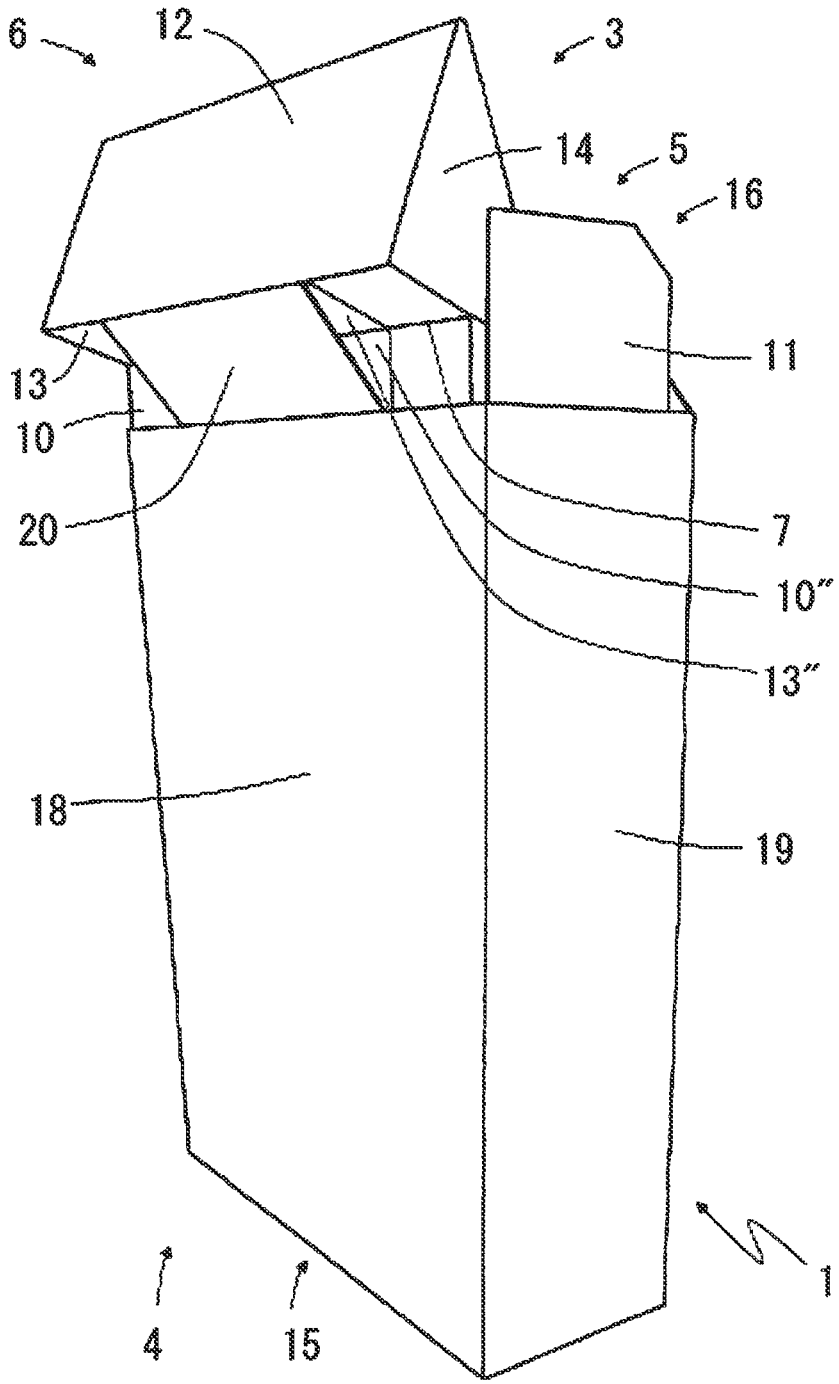
FIG. 3 shows a rear view in perspective of the FIG. 1 packet of cigarettes in an open configuration.

Number 1 in FIGS. 1, 2 and 3 indicates as a whole a rigid, slide-open packet of cigarettes, which opens in a translatory (linear) movement.

The FIG. 1 packet 1 of cigarettes comprises a wrapped, i.e. foil-wrapped group 2 of cigarettes (shown schematically in FIG. 2). Packet 1 of cigarettes also comprises a rigid inner container 3 actually containing the wrapped group 2 of cigarettes; and a rigid outer container 4, which houses inner container 3 to allow inner container 3 to slide in a translatory movement, with respect to outer container 4, between a closed configuration (FIG. 1), in which inner container 3 is inserted fully inside outer container 4, and an open configuration (FIGS. 2 and 3), in which inner container 3 is partly extracted from outer container 4 to allow access to wrapped group 2 of cigarettes.

Inner container 3 is parallelepiped-shaped with a rectangular cross section, is cup-shaped, and comprises an open top end 5. Inner container 3 comprises a cup-shaped lid 6 hinged to inner container 3 along a hinge 7 to rotate, with respect to inner container 3, between an open position (FIGS. 2 and 3) and a closed position (FIG. 1) opening and closing open top end 5 respectively.

Figure 4:
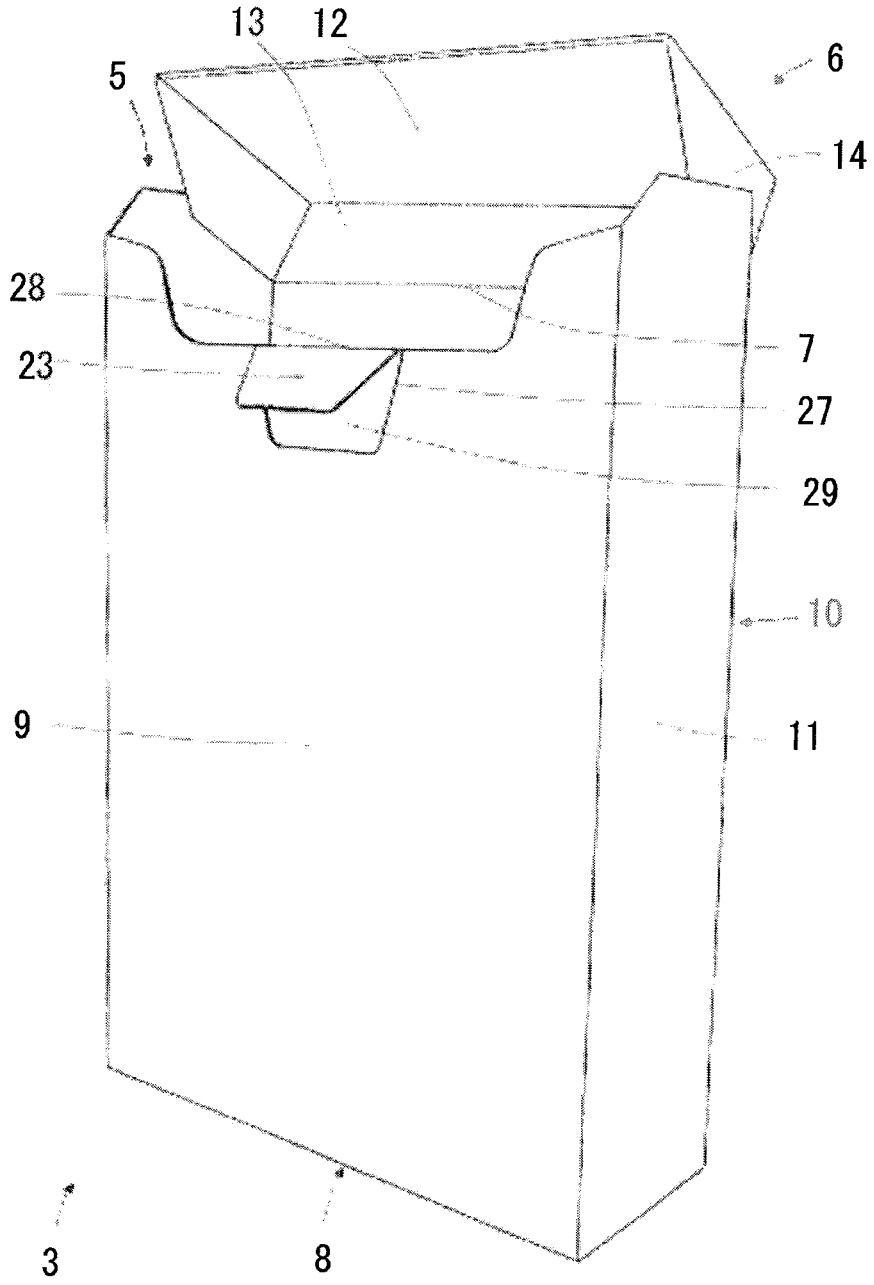
FIG. 4 shows a front view in perspective of an inner container of the FIG. 1 packet of cigarettes.

As shown more clearly in FIG. 4, inner container 3 comprises a bottom wall 8 opposite open top end 5; a front wall 9 and rear wall 10 opposite and parallel to each other; and two parallel lateral walls 11 interposed between walls 9 and 10. Four longitudinal edges are defined between walls 9 and 10 and lateral walls 11; and four transverse edges are defined between walls 9, 10, 11 and bottom wall 8.

Lid 6 is cup-shaped, and comprises a top wall (which is parallel to and opposite bottom wall 8 of inner container 3 when lid 6 is closed); a rear wall 13 connected to rear wall 10 of inner container 3 by hinge 7; and two parallel lateral walls 14. It is important to note that lateral walls 14 of lid 6 are preferably-located inwards of lateral walls 11 of inner container 3, as shown clearly in FIG. 4.

Figure 5:
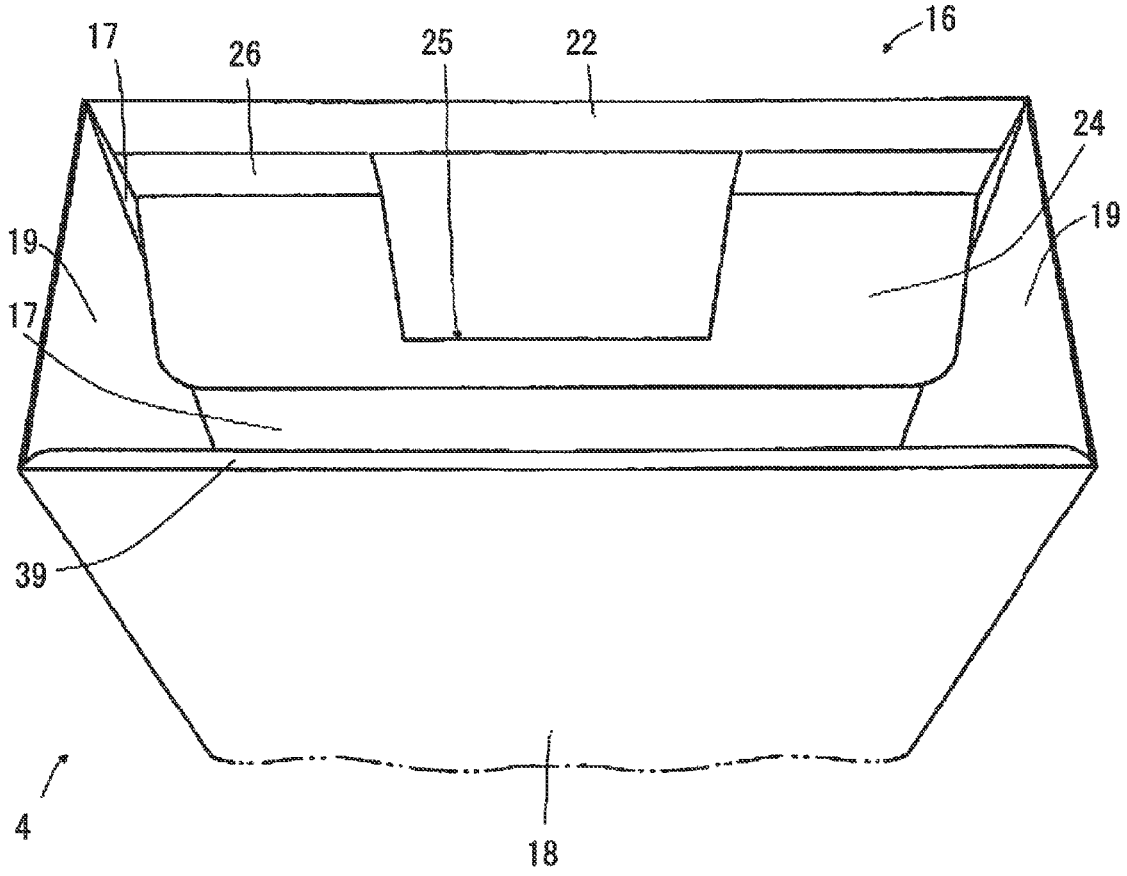
FIG. 5 shows a topside view in perspective of an outer container of the FIG. 1 packet of cigarettes.

As shown in FIG. 5, outer container 4 is cup-shaped, is parallelepiped-shaped with a rectangular cross section, and comprises a bottom wall 15 opposite an open top end 16; a front wall 17 and rear wall 18 opposite and parallel to each other; and two parallel lateral walls 19 interposed between walls 17 and 18. Four longitudinal edges are defined between walls 17 and 18 and lateral walls 19; and four transverse edges are defined between walls 17, 18, 19 and bottom wall 15.

In the embodiment shown in the drawings, all the edges are square; in alternative embodiments not shown, some (longitudinal and/or transverse) edges may be bevelled or rounded.

As shown in FIG. 3, rear wall 13 (more specifically, a top edge of rear wall 13) of lid 6 is connected to rear wall 18 of outer container 4 by a connecting tab 20 to rotate lid 6 'automatically' (i.e. without the user having to touch lid 6) as inner container 3 slides with respect to outer container 4. In other words, by means of connecting tab 20 connecting rear wall 13 of lid 6 mechanically to rear wall 18 of outer container 4, inner container 3, as it slides with respect to outer container 4 from the closed to the open configuration, pushes lid 6 from the closed to the open position 'automatically' (i.e. without the user having to touch lid 6); and similarly, as inner container 3 slides with respect to outer container 4 from the open to the closed configuration, lid 6 is pushed by inner container 3 from the open to the closed position 'automatically' (i.e. without the user having to touch lid 6). The user therefore need simply exert sufficient thrust to slide inner container 3 with respect to outer container 4, without having to touch lid 6, which is rotated 'automatically'.

In the embodiment shown in the drawings, bottom wall 15 of outer container 4 has a through opening 21 (FIG. 9) allowing access to bottom wall 8 of inner container 3 to exert thrust on inner container 3 to move it between the closed and open configurations. In a different, equivalent embodiment not shown, through opening 21 is formed in front wall 17 of outer container 4 or astride front wall 17 and a lateral wall 19 of outer container 4.

As shown in FIGS. 1 and 2, outer container 4 comprises a sealing flap 22 for preventing tobacco powder spill through the gap between the front edge of top wall 12 of lid 6 of inner container 3 and the corresponding top edge of front wall 17 of outer container 4. Sealing flap 22 is hinged to the top edge of front wall 17 of outer container 4, and is movable between a work position (shown in FIG. 1 and assumed in the closed configuration, i.e. when inner container 3 is fully-inserted inside outer container 4), and a rest position (shown in FIG. 2 and assumed in the open configuration, i.e. when inner container 3 is extracted partly from outer container 4).

In the work position, sealing flap 22 is perpendicular to front wall 17 of outer container 4 and located beneath top wall 12 of lid 6 of inner container 3, to prevent tobacco powder spill by 'sealing' the gap between the front edge of top wall 12 of lid 6 of inner container 3 and the opposite top edge of front wall 17 of outer container 4. In the rest position (as shown clearly in FIG. 2), sealing flap 22 is parallel to the front wall 17 of the outer container 4, to avoid interfering with the movement of inner container 3 with respect to outer container 4.

As shown in FIG. 4, inner container 3 comprises a first actuating tab 23 integral with front wall 9 of inner container 3 and projecting towards front wall 17 of outer container 4.

As shown in FIG. 5, outer container 4 comprises a second actuating tab 24, which is connected mechanically to sealing flap 22, is located between front wall 17 of outer container 4 and front wall 9 of inner container 3, and is engaged by first actuating tab 23, as inner container 3 moves into the closed configuration, to draw sealing flap 22 into the work position using the movement of inner container 3. In other words, as inner container 3 moves into the closed configuration, first actuating tab 23, integral with front wall 9 of inner container 3, engages and pushes second actuating tab 24 downwards, thus drawing sealing flap 22, connected to second actuating tab 24, into the work position.

As inner container 3 moves into the closed configuration, the mechanical interaction produced between actuating tabs 23 and 24 therefore also has a mechanical effect on sealing flap 22, which is drawn by second actuating tab 24 into the work position. This therefore ensures sealing flap 22 is always positioned correctly when closing packet 1 of cigarettes, and always returns 'automatically' (i.e. with no help from the user) from the rest to the work position as inner container 3 is pushed from the open to the closed configuration (i.e. is pushed inside outer container 4).

Figure 6:
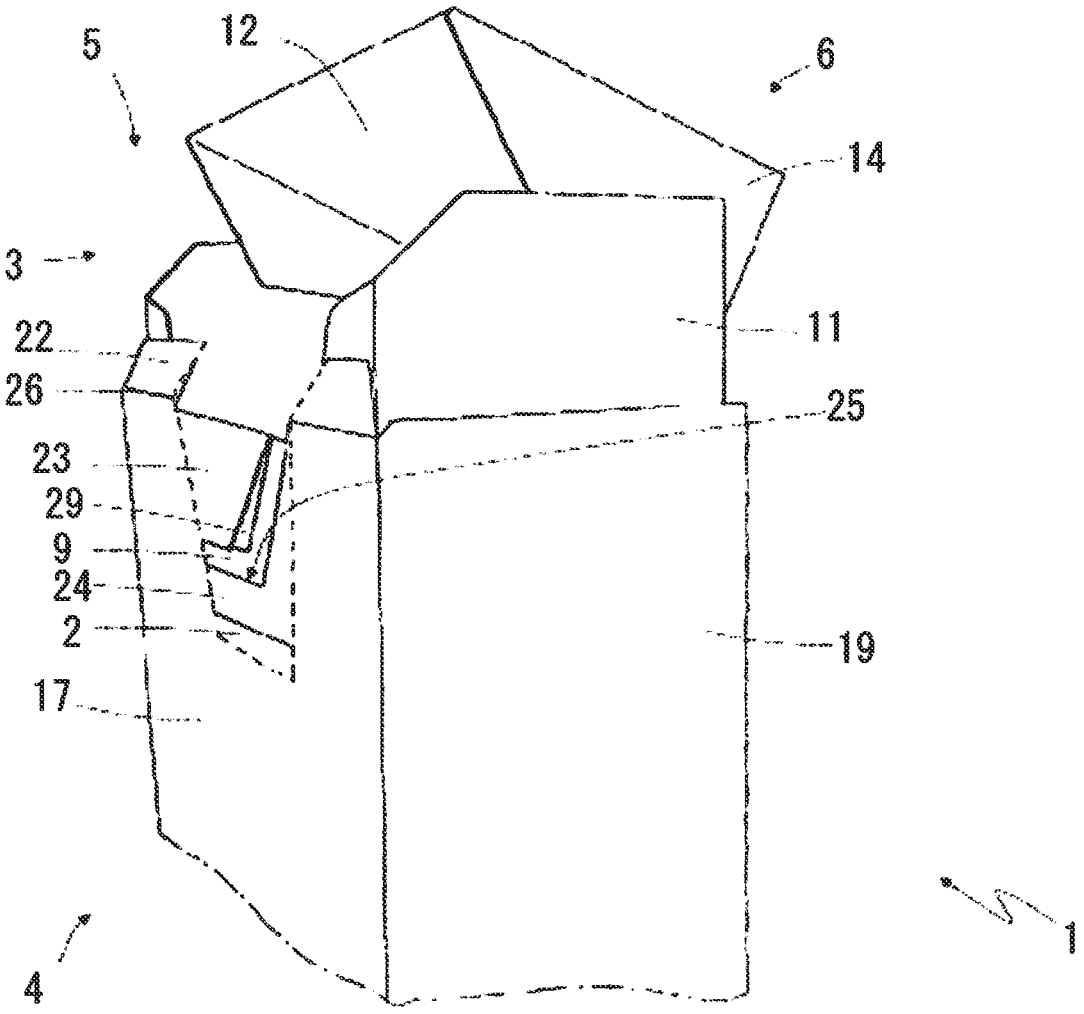
FIG. 6 shows a detail of the FIG. 1 packet of cigarettes in two different configurations.
Figure 7:
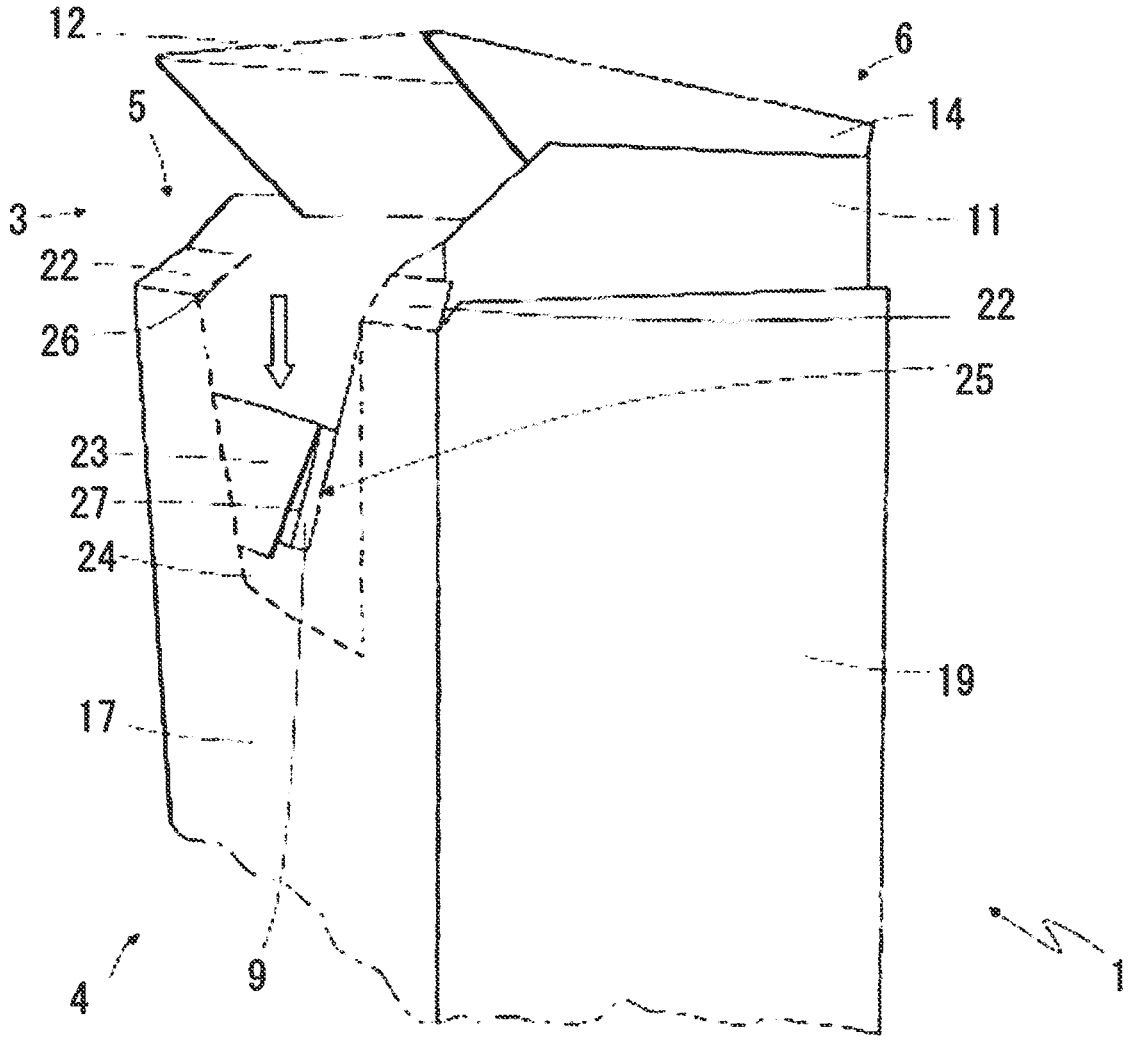
FIG. 7 shows a detail of the FIG. 1 packet of cigarettes in two different configurations.

As shown in FIG. 5, second actuating tab 24 has a central through opening 25 which is engaged by first actuating tab 23, i.e. actuating tab 23 fits inside through opening 25 in actuating tab 24 to lock onto and draw (push) actuating tab 24 (as shown schematically in FIGS. 6 and 7).

More specifically, FIG. 6 shows first actuating tab 23 engaging through opening 25 in second actuating tab 24, with sealing flap 22 still in the rest position; and FIG. 7 shows second actuating tab 24 being drawn by first actuating tab 23 to lower sealing flap 22 into the work position.

In a preferred embodiment, actuating tab 24 is connected to sealing flap 22 by a connecting flap 26, which is hinged on one side to actuating tab 24 (i.e. is connected to actuating tab 24 along a fold line to permit relative rotation), and is hinged to sealing flap 22 on the opposite side (i.e. is connected to sealing flap 22 along a fold line to permit relative rotation). Through opening 25 preferably also extends through connecting flap 26.

Figure 8:
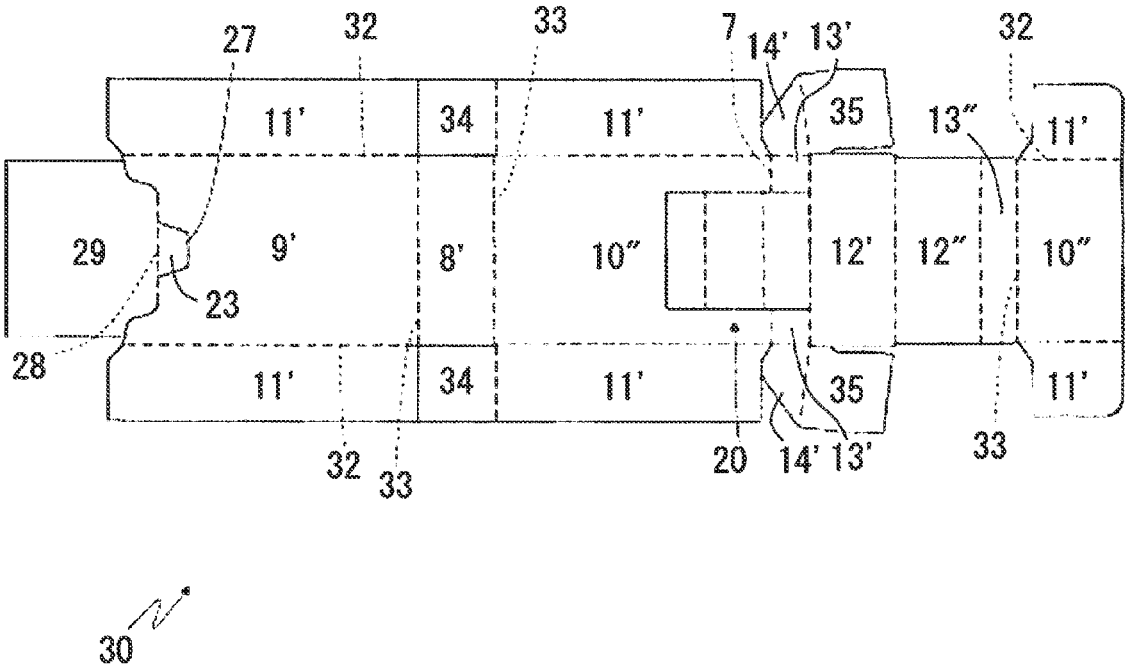
FIG. 8 shows a plan view of a blank from which to form an inner container of the FIG. 1 packet of cigarettes.

As shown in FIGS. 4 and 8, first actuating tab 23 is defined by a portion of front wall 9 of inner container 3, which is separated from the rest of front wall 9 of inner container 3 by a U-shaped through cut 27, and by a fold line 28 joining the two ends of U-shaped through cut 27.

In a preferred embodiment, inner container 3 also comprises a lift tab 29 separated from first actuating tab 23 and from front wall 9 by fold line 28 (i.e. lift tab 29 and first actuating tab 23 are initially side by side, and are separated by fold line 28). Lift tab 29 is folded 180° about fold line 28 onto an inner surface of front wall 9 of inner container 3. The function of lift tab 29 is to lift first actuating tab 23 with respect to front wall 9 of inner container 3 using the springback forces inside the packing material: when lift tab 29 is rotated 180° about fold line 28, first actuating tab 23 (due to the springback forces inside the packing material) rotates similarly about fold line 28, and is thus raised with respect to front wall 9 of inner container 3 (as shown in FIG. 4).

Figure 9:
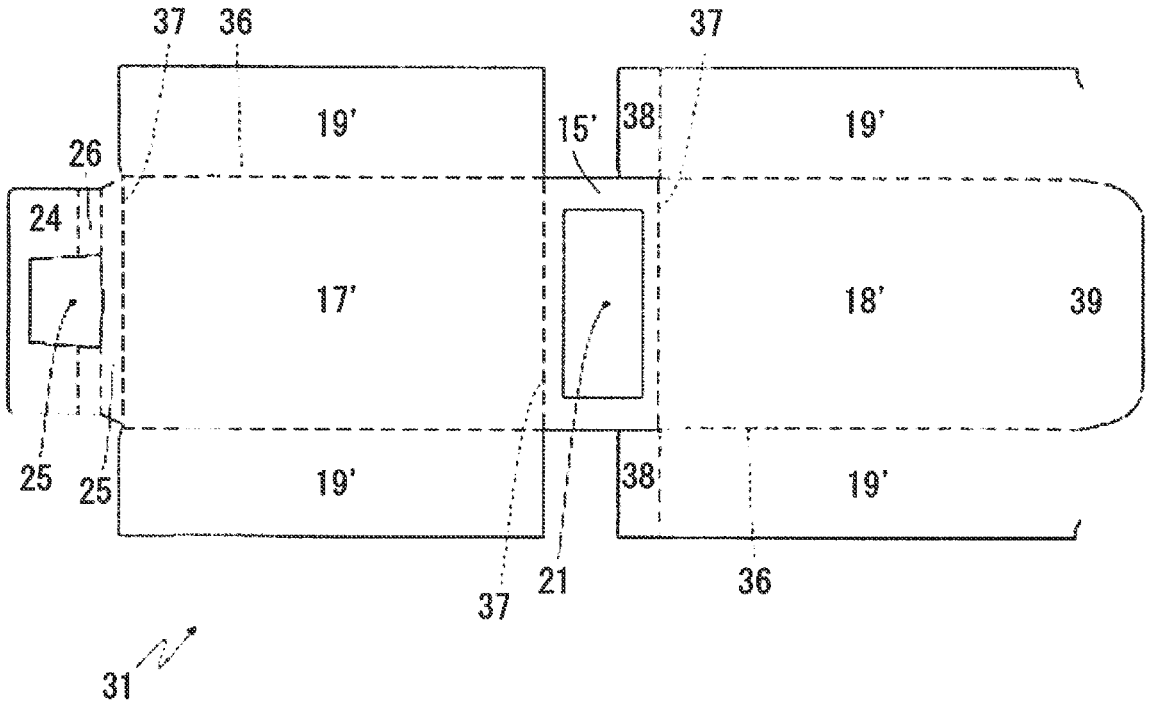
FIG. 9 shows a plan view of a blank from which to form an outer container of the FIG. 1 packet of cigarettes.

Containers 3 and 4 of packet 1 of cigarettes in FIGS. 1-7 are formed from respective blanks 30 and 31 shown in FIGS. 8 and 9 respectively. Blanks 30 and 31 each comprise, among other things, a number of elements, which are indicated, where possible, using the same reference numbers, with superscripts, as for the corresponding walls of respective container 3, 4.

As shown in FIG. 8, blank 30 has two longitudinal fold lines 32 and a number of transverse fold lines 33, which define, between longitudinal fold lines 32, a panel 9' forming front wall 9 of inner container 3; a panel 8' forming bottom wall 8 of inner container 3; a panel 10' forming rear wall 10 of inner container 3; a panel 13' forming rear wall 13 of lid 6; a panel 12' forming top wall 12 of lid 6; a reinforcing panel 12" which is glued to the inside of panel 12'; a reinforcing panel 13" which is glued to the inside of panel 13'; and a reinforcing panel 10" which is glued to the inside of panel 10'.

Panel 9' has two wings 11', which form respective outer portions of lateral walls 11 of inner container 3, are located on opposite sides of panel 9', and are connected to panel 9' by longitudinal fold lines 32. Panel 10' has two wings 11", which form respective inner portions of lateral walls 11 of inner container 3, are located on opposite sides of panel 10', and are connected to panel 10' by longitudinal fold lines 32. Panel 13' has two wings 14', which form lateral walls 14 of lid 6, are located on opposite sides of panel 13', and are connected to panel 13' by longitudinal fold lines 32. Panel 10" has two reinforcing wings 11'", which are glued to the inside of corresponding wings 11", are located on opposite sides of panel 10", and are connected to panel 10" by longitudinal fold lines 32.

Each wing 11" has a tab 34, which is connected to wing 11" by a transverse fold line 33, is folded 90° with respect to wing 11", and may be glued to an inner surface of panel 8'. Each wing 14' has a tab 35, which is connected to wing 14' by a transverse fold line 33, is folded 90° with respect to wing 14', and may be glued to an inner surface of panel 12'.

As shown in FIG. 9, blank 31 has two longitudinal fold lines 36 and a number of transverse fold lines 37, which define, between longitudinal fold lines 36, a panel 17' forming front wall 17 of outer container 4; a panel 15' forming bottom wall 15 of outer container 4; a panel 18' forming rear wall 18 of outer container 4; and said flaps 22, 26 and tab 24, which are connected to one another by transverse fold lines 37.

Panel 17' has two wings 19', which form respective outer portions of lateral walls 19 of outer container 4, are located on opposite sides of panel 17', and are connected to panel 17' by longitudinal fold lines 36. Panel 18' has two wings 19", which form respective inner portions of lateral walls 19 of outer container 4, are located on opposite sides of panel 18', and are connected to panel 18' by longitudinal fold lines 36.

Each wing 19" has a tab 38, which is connected to wing 19" by a transverse fold line 37, is folded 90° with respect to wing 19", and may be glued to an inner surface of panel 15'. Finally, a tab 39 is connected to panel 18' along a transverse fold line 37, is folded 180° onto the inner surface of panel 18', and is glued to connecting tab 20 (in known manner not shown).

Packet 1 of cigarettes described has the advantage, thanks to the mechanical interaction between actuating tabs 23 and 24 as inner container 3 moves into the closed configuration, of ensuring sealing flap 22 is always positioned correctly when closing packet 1 of cigarettes, i.e. sealing flap 22 always returns 'automatically' from the rest to the work position as inner container 3 is pushed inside outer container 4.

An important point to note is that, compared with similar known rigid, hinged-lid, slide-open packets of cigarettes, packet 1 of cigarettes described is still cheap and easy to produce, by actuating tabs 23 and 24 being easy to provide and fold. In fact, no particularly complicated elements are added to blanks 30 and 31, which are therefore folded on the packing machine with only a few additional movements to form containers 3 and 4.

Finally, the entire design of packet 1 of cigarettes may also be applied to producing a carton of cigarettes, which is substantially the same as packet 1 of cigarettes, and differs solely by containing an orderly group of packets of cigarettes as opposed to a group of cigarettes.

What is claimed is:

1. A package of tobacco articles, comprising:

an inner container which is adapted to house a group of tobacco articles, having an open top end and a lid hinged to the inner container to close the open top end;

an outer container housing the inner container to allow the inner container to slide with respect to the outer container between a closed configuration, in which the inner container is inserted inside the outer container, and an open configuration, in which the inner container is partly extracted from the outer container;

a sealing flap hinged to a top edge of a front wall of the outer container and movable between a work position, in which the sealing flap is perpendicular to the front wall of the outer container and located beneath a top wall of the lid of the inner container, and a rest position, in which the sealing flap is parallel to the front wall of the outer container;

a first actuating tab integral with a front wall of the inner container and projecting towards the front wall of the outer container; and a second actuating tab, which is connected mechanically to the sealing flap, is located between the front wall of the outer container and the front wall of the inner container, and is engaged by the first actuating tab, when the inner container moves into the closed configuration, to draw the sealing flap into the work position, using the movement of the inner container.

2. The package as claimed in claim 1, wherein the second actuating tab has a central through opening which is engaged by the first actuating tab.

3. The package as claimed in claim 2, wherein the first actuating tab engages the through opening in the second actuating tab to lock onto and draw the second actuating tab.

4. The package as claimed in claim 1, wherein the second actuating tab is connected to the sealing flap by a connecting flap hinged on one side to the second actuating tab, and on the opposite side to the sealing flap.

5. The package as claimed in claim 4, wherein the second actuating tab has a central through opening which is engaged by the first actuating tab and also extends through the connecting flap.

6. The package as claimed in claim 1, wherein the first actuating tab is defined by a portion of the front wall of the inner container, which is separated from the rest of the front wall of the inner container by a U-shaped through cut, and by a fold line joining the two ends of the U-shaped through cut.

7. The package as claimed in claim 6, wherein the inner container comprises a lift tab separated from the first actuating tab by the fold line.

8. The package as claimed in claim 7, wherein the lift tab is folded 180° about the fold line onto an inner surface of the front wall of the inner container.

* * * * *